US008003923B2

(12) United States Patent
Wilsdorf

(10) Patent No.: US 8,003,923 B2
(45) Date of Patent: Aug. 23, 2011

(54) HOUSEHOLD APPLIANCE WITH DISPLAY THAT IS RAISED FROM A SURFACE

(75) Inventor: Gerd Wilsdorf, Olching (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 643 days.

(21) Appl. No.: 12/079,898

(22) Filed: Mar. 28, 2008

(65) Prior Publication Data

US 2008/0236563 A1 Oct. 2, 2008

(30) Foreign Application Priority Data

Mar. 30, 2007 (DE) ..... 10 2007 015 569

(51) Int. Cl.
*H05B 1/02* (2006.01)

(52) U.S. Cl. ..... 219/506; 219/502; 219/508; 219/445.1

(58) Field of Classification Search ..... 219/445.1, 219/487, 506, 720, 494
See application file for complete search history.

(56) References Cited

U.S. PATENT DOCUMENTS

| | | | | |
|---|---|---|---|---|
| 5,300,759 | A * | 4/1994 | Dodson | 219/506 |
| 7,265,325 | B2 * | 9/2007 | Herzog | 219/633 |
| 2003/0209018 | A1 * | 11/2003 | Becke et al. | 62/126 |
| 2006/0086258 | A1 * | 4/2006 | Sharpe | 99/331 |
| 2007/0210057 | A1 * | 9/2007 | Stahl et al. | 219/400 |

FOREIGN PATENT DOCUMENTS

| | | |
|---|---|---|
| DE | 102004062752 A1 | 7/2006 |
| EP | 1 569 057 | 8/2005 |
| JP | 2-230026 | 9/1990 |
| WO | WO 97/26486 | 7/1997 |
| WO | WO 02/14593 | 2/2002 |
| WO | WO 2006/048748 | 5/2006 |
| WO | WO 2006/069832 | 7/2006 |

OTHER PUBLICATIONS

National Search Report DE 10 2007 015 569.9.

* cited by examiner

*Primary Examiner* — Mark H Paschall
(74) *Attorney, Agent, or Firm* — James E. Howard; Andre Pallapies

(57) ABSTRACT

A domestic appliance device with a light signal unit, a control unit, which is designed to interact with the light signal unit for outputting information by means of a light signal, and a carrier unit for supporting the light signal unit.

21 Claims, 6 Drawing Sheets

HOUSEHOLD APPLIANCE WITH DISPLAY THAT IS RAISED FROM A SURFACE

BACKGROUND OF THE INVENTION

There are known domestic appliances, such as cookers for example, which are provided with an output device for outputting information about a domestic appliance operating parameter by means of a light signal, such as by means of a light emitting diode for example.

BRIEF SUMMARY OF THE INVENTION

The object of the invention consists in particular of providing a domestic appliance device for a generic domestic appliance with improved characteristics as regards making a greater visual impact in the output of information.

The invention is based on a domestic appliance device with light signal unit, a control unit which is designed to interact with the light signal unit for outputting information by means of a light signal, and a carrier unit for supporting the light signal unit.

It is proposed that the carrier unit has a subarea for supporting the light signal unit which is raised up from a visible domestic appliance surface. This gives the unit high visual impact and ensures that the information will be quickly perceived.

A subarea "which is raised up from a visible domestic appliance surface", is intended in this connection to be understood in particular as a subarea which, at least in the normal direction of the domestic appliance viewing surface, stands out from this visible domestic appliance surface. "Stands out from the normal direction" should be understood in particular as a direction of the normal to the domestic appliance viewing area which leads away from a domestic appliance inner chamber delimited by the visible domestic appliance surface. Advantageously the projection of the subarea on the visible domestic appliance surface adjoins this visible domestic appliance surface and is at least essentially surrounded by the visible domestic appliance surface. In such cases the subarea projection is surrounded by at least 50%, advantageously by at least 70% and preferably by at least 90% of the visible domestic appliance surface. A projection is to be understood especially as a projection against the normal direction of the visible domestic appliance surface aligned outwards. Especially advantageously a high visual impact of the light signal unit can be obtained if the subarea projection is completely surrounded by, the visible domestic appliance surface. The subarea for supporting the light signal unit is preferably embodied differently from the light signal unit, especially from an illumination surface intended for emitting a light signal. The subarea in this case features at least one coupling area, which is used for coupling to the light signal unit. The subarea projecting from the visible domestic appliance surface further features a section overlapping the visible domestic appliance surface and a connection means which connects the overlapping section to the visible domestic appliance surface. The overlapping section is advantageously aligned in parallel to the visible domestic appliance surface and the light signal unit is preferably supported in the overlapping section.

A "visible domestic appliance surface" can in this context be understood particularly as a surface of the domestic appliance which is visible to the operator under normal usage conditions of a domestic appliance. If the domestic appliance device is used with a freestanding domestic appliance, the visible domestic appliance surface is especially embodied as a front surface of the domestic appliance, which preferably extends essentially vertically. In this case, and throughout the text, the terms "vertical" and "horizontal" relate to the normal position of the freestanding domestic appliance when a domestic appliance is in operation. Furthermore the visible domestic appliance surface can be formed by a domestic appliance housing surface. The visible domestic appliance surface is preferably embodied as a contiguous surface.

A "light signal" can especially be understood as a signal which is intended for output of information by means of a characteristic of transmitted light, such as especially a luminous intensity, a color, a flashing frequency, a position of a transmission point etc. In this case for example a domestic appliance parameter or a domestic appliance function is assigned a specific color, a specific luminous intensity, a specific transmission position, a specific flashing frequency and/or a further light characteristic appearing as meaningful to the person skilled in the art. Advantageously the light signal unit is intended for output of information by means of a dynamic light signal. A "dynamic light signal" can in this context especially be understood as a signal which is intended for transmission of information by means of a variation of a characteristic of a transmitted light, such as especially by means of a variation of a luminous intensity, a color, a flashing frequency, a position of a transmission point and/or a further light characteristic appearing as meaningful to the person skilled in the art. Preferably this variation occurs during the course of operation of a domestic appliance, advantageously between starting and ending the operation of the domestic appliance. Unlike with a continuous light, a transmission with high information density can be achieved in this way. The light signal unit preferably features a light element for generating light, which is embodied for example as an LED (Light Emitting Diode) and indeed as a semiconductor LED or organic LED, as an incandescent lamp etc. In this case the light element is supported by means of the raised subarea. A light signal unit, by contrast with other display units, a clear text display or a segmented display, offers the advantage of being able to alert an operator to the progress of a domestic appliance operation, even if the operator were at some distance from the domestic appliance and it would thus be difficult for them to read clear text information. Advantageously the light signal unit is intended to allow an operator to perceive information from a distance, where the information can be detected from a distance of over 3 m, advantageously of over 5 m away from the operator. A light signal easily allows information, especially general information about the progress of a domestic appliance operation, to be transmitted during the operation of the domestic appliance.

As an alternative or in addition it is proposed that the carrier unit be embodied by at least one actuation means, which enables a high visual impact of the light signal unit to be achieved. An "actuation means" is to be understood in this context as a means provided for manual actuation by an operator. For example the actuation means can be embodied as an actuation knob or a spindle-shaped actuation button, with the subarea for supporting the light signal unit preferably being embodied by the front side of the actuation means.

An actuation means for actuating a domestic appliance door unit is embodied and/or arranged on the domestic appliance because of its frequency of use such that it can be perceived especially quickly by the operator. A particular visual impact of the light signal unit can thus be achieved if the carrier unit is formed from at least one actuation means for actuating a domestic appliance door unit. The domestic appliance door unit is especially assigned to a domestic appliance functional space such as for example an oven chamber, a dishwasher chamber, a refrigeration chamber etc., and is preferably intended for opening and closing the domestic appliance functional space. The domestic appliance door unit is preferably supported to allow movement relative to the domestic appliance functional space. In this case the actuation means is used, by manual activation by the operator, advantageously for creating a relative movement of the domestic appliance door unit relative to the domestic appliance functional space.

In the preferred embodiment of the invention it is proposed that the carrier unit is raised from a domestic appliance door surface, which enables the visual impact to be advantageously further increased.

An especially rapid perception of the light signal unit by an operator can be achieved if the carrier unit is embodied as a grip unit. A grip unit advantageously represents a domestic appliance unit which is used with an especially high frequency and a particularly prominent constructional unit. The grip unit features at least one grip area on which an operator's hand can be placed, which is gripped by this operator's hand when the unit is actuated.

In this context it is proposed that the grip unit comprise a grip means which features an elongated basic element, which enables a high visual impact of the light signal unit and simple handling of the grip unit to be achieved. An "elongated" basic element can especially be a basic element extending in a longitudinal direction and which is advantageously three times longer, especially advantageously five times longer and preferably ten times longer than its width. In particular the basic element can be embodied in the form of a rail. The longitudinal direction of the grip means can correspond to different directions relative to a domestic appliance basic element to which the grip means is coupled. The longitudinal direction of the grip means can especially correspond to the horizontal or to the vertical direction. In this case and in the entire text the terms "vertical", "horizontal", "top", "bottom", "side" refer to the position of a domestic appliance in which the domestic appliance device is employed under normal application conditions by an end user.

It is further proposed that the domestic appliance device features a domestic appliance functional space and that the subarea for supporting the light signal unit is arranged in front of the domestic appliance functional space, which enables an especially high visual impact of the light signal unit to be achieved. A subarea which is arranged "in front of" the domestic appliance functional space should be in particular be understood to be an area which covers the domestic appliance functional space at least partly externally in the normal direction of the visible domestic appliance surface. In this case the subarea is raised from the visible domestic appliance surface, with a normal running through the subarea in relation to the visible domestic appliance surface penetrating into the domestic appliance functional space. In this case the subarea advantageously overlaps with the domestic appliance functional space. Especially advantageously the subarea is raised from a domestic appliance door surface of a domestic appliance door unit which is provided for closing off the domestic appliance functional space. A "domestic appliance functional space" is especially to be understood as a space which is provided for arranging an object to be handled in a domestic appliance operation and for executing of the domestic appliance operation. The domestic appliance functional space can for example be embodied as a cooking chamber, washing chamber, cooling chamber etc.

In a preferred embodiment of the invention it is proposed that the domestic appliance device features a transmission unit which is provided for establishing a wireless transmission between the light signal unit and a domestic appliance chassis, which enables a space-saving design to be achieved. The transmission unit can be provided for energy and/or information transmission. In particular the transmission unit can feature a transmission means which is provided for inductive energy supply of the light signal unit. It is further conceivable that the transmission unit features a transmission means for establishing a Bluetooth connection and/or an infrared connection.

In a further embodiment of the invention it is proposed that the control unit features a control means which is intended to interact with the light signal unit for output of information about a domestic appliance variable. A "domestic appliance variable" can especially be understood as a variable parameter of a domestic appliance when executing a domestic appliance operation such as cooking, washing, drying, cooling etc, with this variable parameter having a value which can change during the operation of the domestic appliance. For example the domestic appliance variable can be embodied as a temperature, a time, a quantity of a substance etc.

Information can be perceived especially quickly if the light signal unit has a display area which is provided to display at least a section of the signal, and if control means are provided to interact with the light signal unit to map a characteristic value for the domestic appliance variable by means of a variable extent of the signal section in at least one direction. This allows the perception of the characteristic value to be especially fast and intuitive. For example the operator can use the dimension of the displayed signal section to estimate the domestic appliance variable, which is especially advantageous if he is away from the immediate vicinity of the domestic appliance. In this case a remote monitoring of the operation of the domestic appliance by the operator can be achieved. A "signal section" can in this context especially be understood as a section of the display area which is assigned to the transmission of a signal. In this case the signal section differs in at least one feature, such as in its luminous intensity, color, flashing frequency etc., from its environment, with the delimitation from this environment being clearly perceivable for an operator. The signal section is embodied as an illuminated surface which is illuminated by means of at least one lighting means. The signal section can be embodied as a contiguous signal surface. Alternatively the signal can be formed from a combination of separate illuminating surfaces, such as for example in the simultaneous illumination of a series of light means, such as light emitting diodes, which are separate from each other for example.

It is also proposed that the carrier unit be embodied as a grip unit with grip means and the light signal unit includes a display means which extends in the longitudinal direction of the grip means, which means that a larger display area can be easily achieved. A component which "extends" in a particular direction can be understood as a component with a main direction of extension or longitudinal direction aligned in a specific direction.

Furthermore a high information density can be achieved if a display for showing clear text is additionally arranged in a subarea of the carrier unit. For example the display is embodied as an LCD display.

A cost-effective embodiment of the domestic appliance device can be achieved if the light signal unit features a set of light emitting diodes.

In a further embodiment of the invention it is proposed that the domestic appliance device features an input device for an input by an operator which is supported in the subarea of the carrier unit by which a high flexibility in the application of the domestic appliance device can be achieved. Advantageously a value, such as a maximum value for a domestic appliance variable, can be entered manually by the user by means of the input device.

An especially simple operation of the input device can be achieved if the input device features a touch-sensitive input area. A "touch-sensitive" input area can be understood in this context especially as an area which is intended for almost exclusively pressure-free input such as a touch panel for example. Especially advantageously the input device can feature a touch-sensitive slider (or touch slider).

Further advantages emerge from the description of the drawing given below. The drawing shows exemplary embodiments of the invention. The drawing, the description and the claims contain numerous features in combination. The person skilled in the art would expediently also consider the features individually and combine them into further sensible combinations.

DETAILED DESCRIPTION OF THE PRESENT INVENTION

Figure 1:
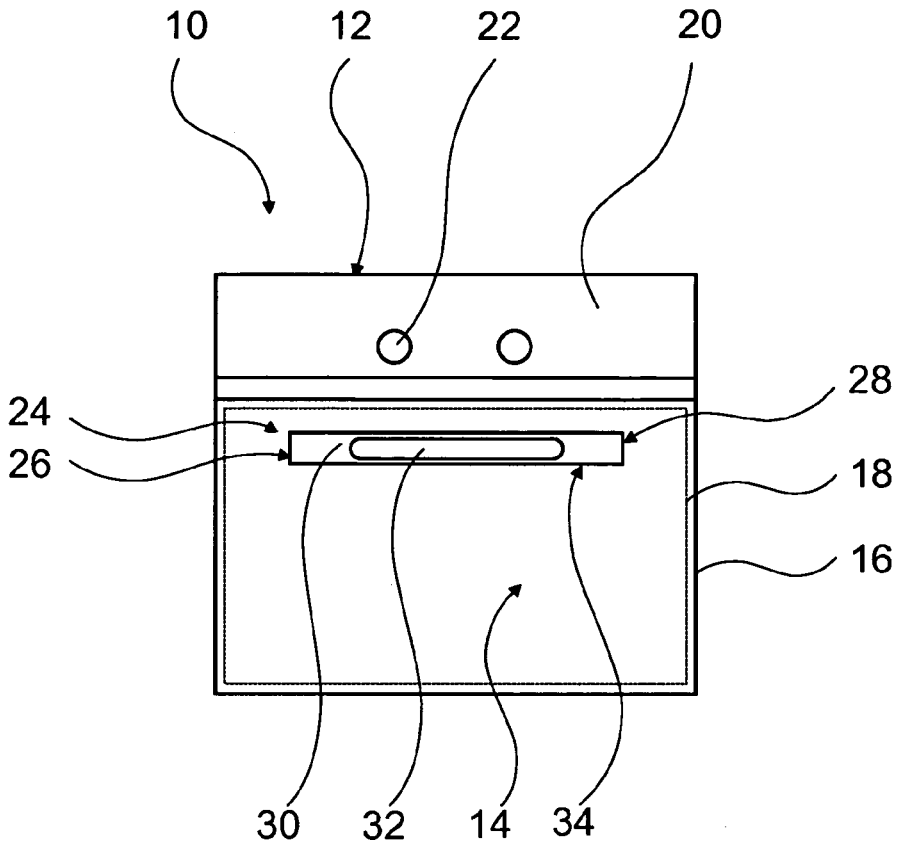
FIG. 1 illustrates an oven with a door grip into which a light signal unit is integrated in accordance with an exemplary embodiment of the present invention.

FIG. 1 shows a front view of a domestic appliance 10 embodied as an oven. The domestic appliance 10, which is embodied as a freestanding domestic appliance, has an appliance chassis 12, which is arranged fixed in relation to the floor and an appliance front area 14 which features a domestic appliance door unit 16 supported in a hinged manner relative to the domestic appliance chassis 12. In its closed position, the domestic appliance door unit 16 of the domestic appliance front area 14 closes off a domestic appliance functional space 18 embodied as a cooking chamber. The domestic appliance 10 also features a panel unit 20 solidly supported on the domestic appliance chassis 12 from which actuation means 22 embodied as knobs project which are used for selecting domestic appliance operations, and specifically cooking operations. The domestic appliance 10 is further provided with a grip unit 24. This features a grip means 26 embodied for actuation of or for opening and closing the domestic appliance door unit 16. The grip means 26 has a basic element 30 embodied as an elongated bar which extends horizontally across a significant part of the width of the domestic appliance.

The domestic appliance 10 further comprises a light signal unit 32. This light signal unit 32, which is depicted in an abstract way in FIG. 1, is used for output of information about a domestic appliance variable by creating a dynamic light signal. Different exemplary embodiments of the light signal unit 32 as well as its method of operation are explained in greater detail below with reference to FIGS. 3*a* to 3*d* and 4 to 7. The light signal unit 32 is integrated into the grip unit 24, and indeed on the front side of the grip means 26 or of the actuation means 28. To this end the grip unit 24, and indeed the grip means 26 or the actuation means 28, is embodied as the carrier unit 34 for supporting the light signal unit 32. This carrier unit 34 features a mounting unit not shown in the figure for accommodating the light signal unit 32.

Figure 2:
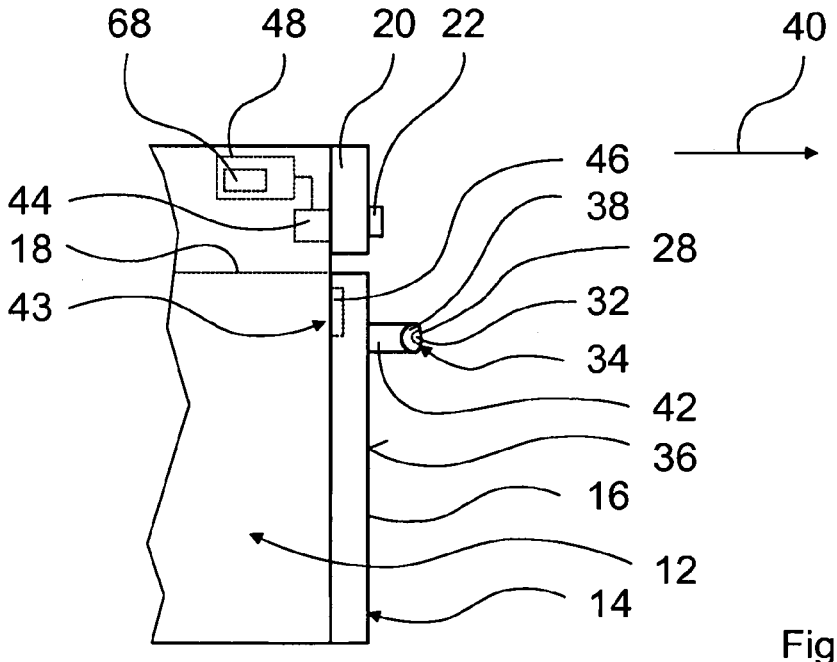
FIG. 2 is a side view of the oven of FIG. 1.

FIG. 2 shows the domestic appliance 10 in a side view. The domestic appliance door unit 16 forms a visible domestic appliance surface 36, which in the closed position of the domestic appliance door unit 16 is aligned essentially vertically. With normal usage of the domestic appliance 10, the visible domestic appliance surface 36 is facing towards an operator standing in front of the domestic appliance front area 14. The grip means 26 embodied as a rail is connected via a connecting means 42 embodied as connecting webs (see also FIG. 4) with the visible domestic appliance surface 36 embodied as the domestic appliance door surface. The grip means 26 forms a subarea 38 which is raised from the visible domestic appliance surface 36 in the horizontal direction 40 or outwards at right angles to the visible domestic appliance surface 36. The light signal unit 32 is supported in the subarea 38 which overlaps the visible domestic appliance surface 36. The integration of the light signal unit 32 into the grip unit 24 means that the light signal unit 32 is arranged in the domestic appliance front area 14 in the closed position of the domestic appliance door unit 16 in front of the domestic appliance functional space 18.

To supply energy to the light signal unit 32 and for transmission of data to the light signal unit 32 the domestic appliance 10 is provided with a transmitter unit 43 which is provided for establishing a wireless transmission between the light signal unit 32 and the domestic appliance chassis 12. The transmission unit 43 features a first transmission means 44, which is arranged in the domestic appliance chassis 12. In operation a wireless transmission, and indeed an inductive transmission of energy to a second transmission means 46 which is supported in the domestic appliance door unit 16 is established. As an alternative the second transmission means 46 can be arranged in the grip means 26. A control unit 48 which is especially used for control of the light signal unit 32, is further arranged in the domestic appliance chassis 12. The control unit 48 is used especially to interact with the light signal unit 32 for output of information by the light signal unit 32. To this end the control unit 48 is effectively connected to the transmission unit 43, especially the transmission means 44.

Different exemplary embodiments of the light signal unit 32 are shown in FIGS. 3*a* to 3*d*. In these figures the grip unit 24 is shown in a view from the front and a view from the side respectively.

Figure 3A:
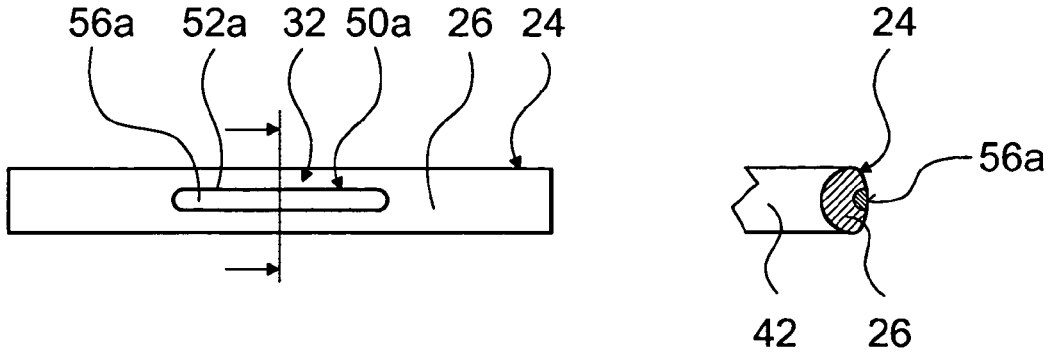
FIG. 3*a* illustrates a door grip with a light signal embodied as an "infoline" in accordance with an exemplary embodiment of the present invention.

The light signal unit 32, which is embodied as a display unit 50*a*, can be seen in FIG. 3*a*. The display unit 50*a* features a display means 52*a* which is embodied as a linear display known as an "infoline". The display means 52*a* is formed by an elongated display body which is arranged in the front side of the grip means 26 and which extends in the longitudinal direction of the grip means 26. The front surface of the display means 52*a* forms a display area 56*a*, which can be illuminated by a light unit with at least one light means not shown in any greater detail here. The display area 56*a* preferably consists of a translucent material. The functional principle of the display means 52*a* embodied as the infoline is explained in more detail below with reference to FIGS. 4 to 7.

Figure 3B:
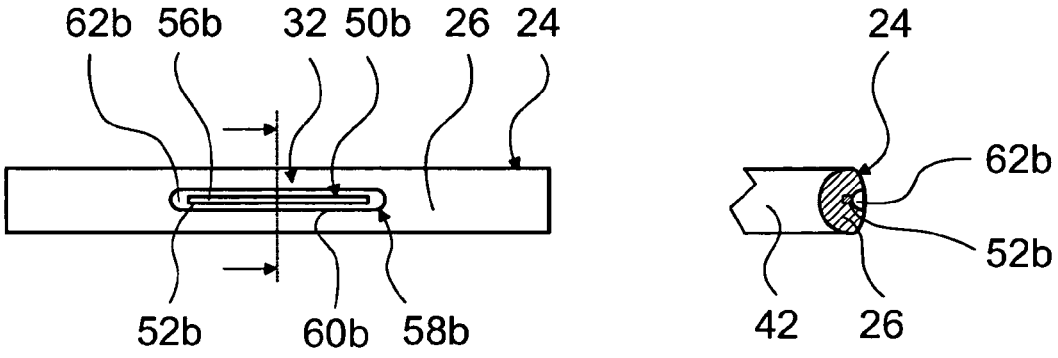
FIG. 3*b* illustrates a door grip with an "infoline" and a touch slider in accordance with an exemplary embodiment of the present invention.

FIG. 3*b* represents a further exemplary embodiment of the light signal unit 32. The light signal unit 32 is embodied as a display unit 50*b* which comprises a display means 52*b* formed by an elongated display body. This display means 52*b* is embodied according to the exemplary embodiment of FIG. 3*a* as an infoline. Furthermore an input device 58*b* is mounted in the grip unit 24, in the subarea 38 with an input means 60*b* which forms a touch-sensitive input area 62*b*. This input means 60*b* is embodied by an elongated body which is arranged centrally in the front side of the grip means 26 and extends in the longitudinal direction of the grip means 26. The input means 60*b* forms the touch-sensitive input area 62*b* in the form of finger indentation. In this case the input means 60*b* is embodied as a touch-sensitive slider (or "touch slider"), which is provided for stepless adjustment of a domestic appliance variable such as a temperature, through being touched by an operator. The domestic appliance variable can in this example be displayed by means of a display unit arranged in the transmitter unit 20. As can be seen from the sectional view in the figure, the display means 52*b* is arranged behind the input means 60*b*. In this case the display means 52*b* is covered by the input area 62*b*. The display means 52*b* forms a display area 56*b*, which can be illuminated by at least one light unit not shown in any greater detail in the figure and corresponds to a subarea of the input area 62*b*. This subarea of the input area 62*b* is thus used for displaying information. The input means 60*b* interacts with the display means 52*b* to form an operating unit which is used for output and for input of information about a domestic appliance variable.

Figure 3C:
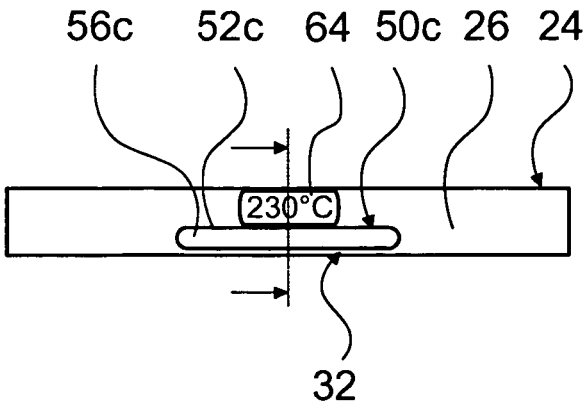
FIG. 3*c* illustrates a door grip with an "infoline" and a display in accordance with an exemplary embodiment of the present invention.
Figure 3C:
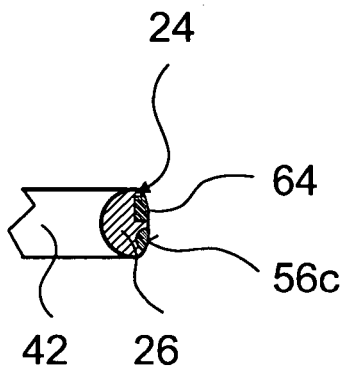

A further exemplary embodiment of the light signal unit 32 is shown in FIG. 3*c*. The light signal unit 32 is embodied as a display unit 50*c*, which, as in the exemplary embodiment of FIG. 3*a*, features a display means 52*c* embodied as an infoline with a display area 56*c*. For more details the reader is referred to the above description. Furthermore a display means is embodied as a display 64 in the grip unit 24, and is on the front side of the grip means 26. It is embodied as an LCD display, by means of which information about a domestic appliance variable, such as a temperature or a cooking time, can be shown in clear text. In a further embodiment not shown the grip unit 24 can be provided, as an alternative or in addition to the display 64, with a segmented display.

Figure 3D:
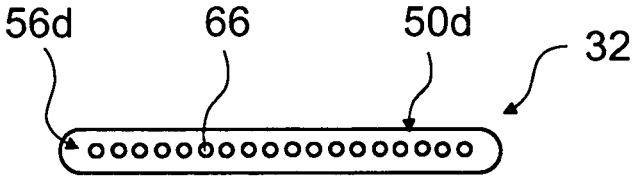
FIG. 3*d* illustrates a light signal unit with an LED string in accordance with an exemplary embodiment of the present invention.

FIG. 3*d* shows a further exemplary embodiment of the light signal unit 32, which is embodied as a display unit 50*d*. This features a display area 56*d* which is formed by a set of light emitting diodes (or LEDs) 66. The light emitting diodes 66 are arranged in a row extending in the longitudinal direction of the grip means 26. This represents a simple and cost-effective embodiment of an infoline.

The functional principle of an infoline is explained in greater detail in FIGS. 4 to 7 with reference to the version of the display unit labeled 50*a*. The following description also applies to the embodiments 50*b*, 50*c* and 50*d* of the display units. FIGS. 4 to 7 show the grip unit 24 with the grip means 26 in a perspective view.

Figure 4:
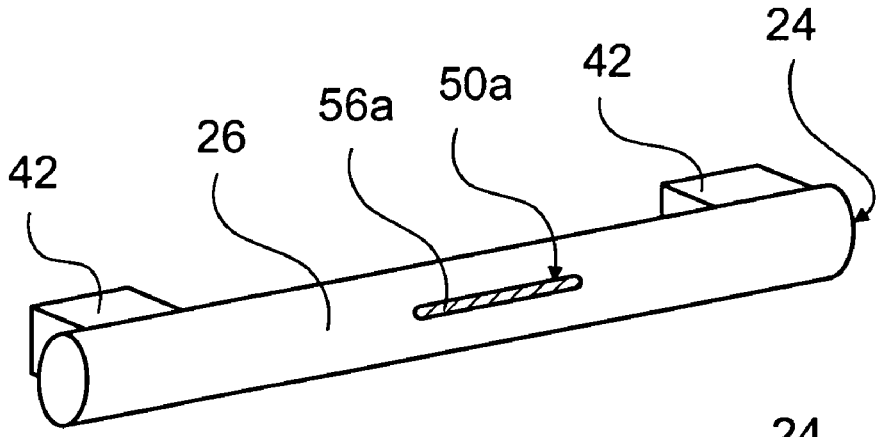
FIG. 4 is a perspective view of the door grip of FIG. 3*a;*
Figure 5:
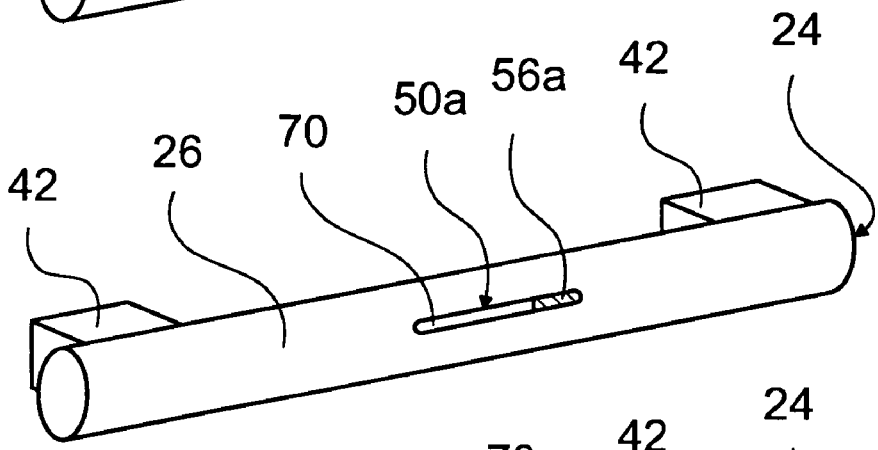
FIG. 5 is a perspective view of the door grip of FIG. 3*a* illustrating a variable-length signal section.

FIG. 4 shows the light signal unit 32 or the image display unit 50*a* with the display area 56*a* in the non-illuminated state. In this case a non-illuminated section of the display area 56*a* is identified in the figures by means of a cross-hatched area. It is assumed that an operator is setting a cooking time via the actuating means 22. This cooking time can alternately be preset by a cooking program. Information is output by means the display unit 50*a* about a domestic appliance variable embodied as a cooking time, where the cooking time set represents a maximum value of the domestic appliance variable which the domestic appliance variable can assume during a cooking operation. In the execution sequence of the cooking operation a signal section 70 of the display area 56*a* is illuminated, with the extent of the signal section 70 being variable or corresponding to a progress variable which is proportional to the elapsed cooking time. This is shown in FIG. 5. The signal section 70 distinguishes itself from its surroundings, i.e. from the non-illuminated section of the display area 56*a* and front surface of the grip means 26, by its luminous intensity and color. The variable display of the signal section 70 is controlled by control means 68 such that the ratio of the extent of the signal section in the longitudinal direction of the grip means 26 to the overall extent of the display means 52*a* in this direction corresponds to the ratio of the elapsed cooking time to the overall cooking period. To this end the control means 68 of the control unit 48 maps the cooking period on the entire extent of the display means 52*d* in the direction of its main extent. Through the increasing extent of the signal section 70 in its longitudinal direction an operator who is away from the immediate vicinity of the domestic appliance 10 can obtain a rough assessment of the elapsed cooking time by glancing at the grip unit 24. The display means 52*d* is suitable for monitoring further operations of the domestic appliance 10, such as pyrolytic self-cleaning for example.

Figure 6:
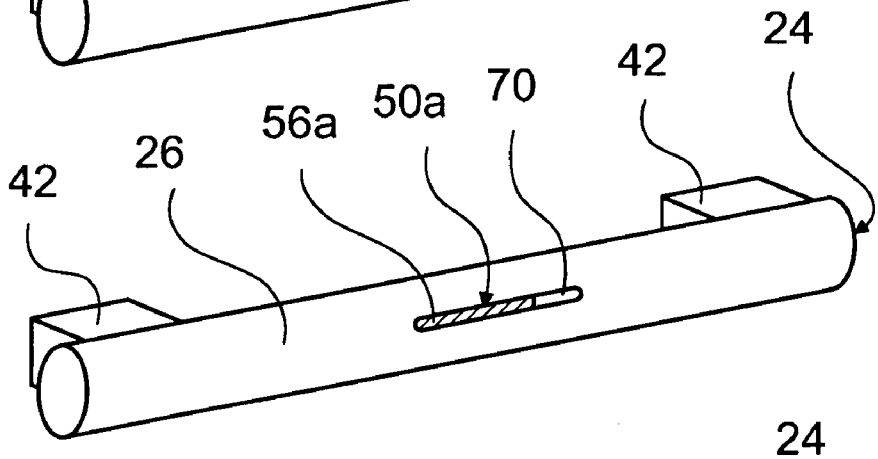
FIG. 6 is a perspective view of the door grip of FIG. 3*a* with the variable-length signal section having another state.

FIG. 6 shows an alternative display module of the display unit 50*a*. In this case the extent of the signal section 70 is proportional to a characteristic value which depends on the domestic appliance variable, i.e. the cooking time. The ratio of the extent of the signal action 70 to the overall extent of the display means 52*a* in its main extension direction corresponds to a characteristic progress variable, which is embodied by the difference between the cooking period and the elapsed cooking time. Accordingly the extent of the signal section 70 over time is smaller. In this way the operator, by glancing at the grip unit 24, can obtain a rough assessment of the remaining cooking time until cooking operation is at an end.

A variable extension of the signal section in two directions is conceivable. For example the signal section can be embodied as a bar display. A signal section can further be provided in the form of a circle or disk segment which during the operation of a domestic appliance has a variable extent in a circumferential direction.

Figure 7:
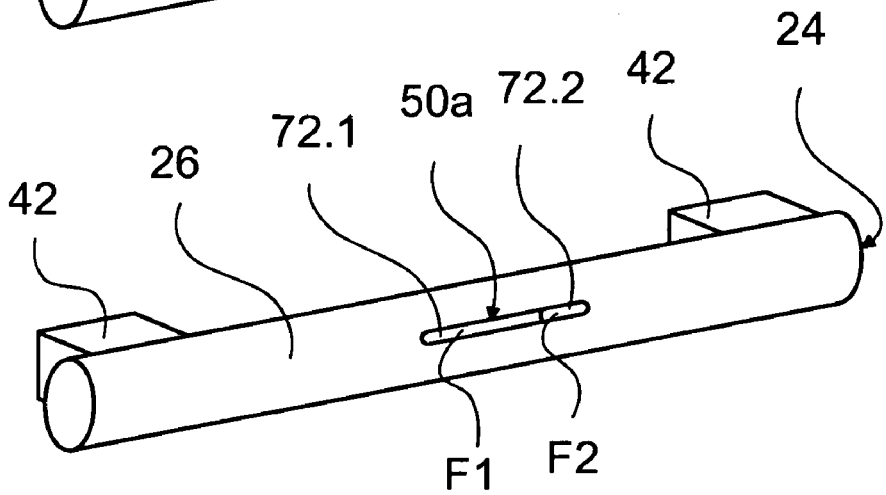
FIG. 7 is a perspective view of a door grip having a multicolored display as an "infoline" in accordance with an exemplary embodiment of the present invention.

The control means 68 is also provided for creation of multi-color light signals through the image display unit 50*a*. This is shown in FIG. 7. In one operating mode a first signal section 72.1 is illuminated in a first color F1, e.g. green. This first signal section, like the signal section 70 in the example depicted in FIG. 5, has an extent which is proportional to the elapsed cooking time. A second signal section 72.2, which with the first signal section 72.1, forms the entire extent of the display area 56*a* in its main direction of extension, is illuminated with a second color F2, e.g. red. This signal section 72.2 has a variable extent which corresponds to the change in extent of the signal section 70 in the example depicted in FIG. 6.

The control means 68 is further programmed with a flashing mode. In this flashing mode a flashing of the displayed signal section 70, 72.1 or 72.2 can occur. A flashing frequency can in particular be assigned to a warning function in order to quickly inform the operator about a malfunction.

Furthermore the control means 68 is provided with a further operating mode in which a signal section is shown which has a constant extent during cooking operation. In this case information is output by means of a flashing frequency or a specific color of the signal section. For example a continuous light with a specific color can indicate an ongoing cooking operation. The end of the cooking operation can then be identified by means of a flashing frequency and/or another color of the signal section. This operating mode is especially suitable for a simple and cost-effective embodiment of the light signal unit 32, in which the light signal unit 32 is embodied by an individual light emitting diode 66 for example.

It is further conceivable to integrate a light signal unit into an actuation knob or into a spindle-shaped actuation button. Thus for example the actuating means 22 (FIG. 1) can feature a light signal unit on its front.

Figure 8:
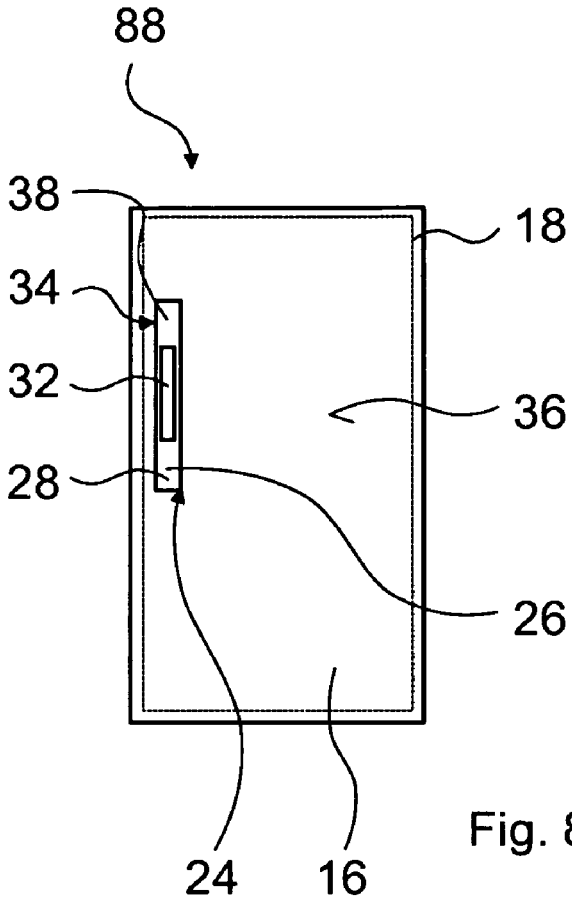
FIG. 8 is an elevation view of a refrigerator appliance with a light signal unit integrated into a door grip in accordance with an exemplary embodiment of the present invention.
Figure 9:
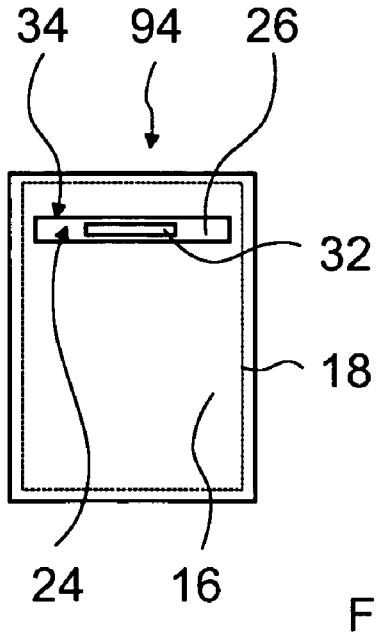
FIG. 9 is an elevation view of a dishwasher with a light signal unit integrated into a door grip in accordance with an exemplary embodiment of the present invention.
Figure 10:
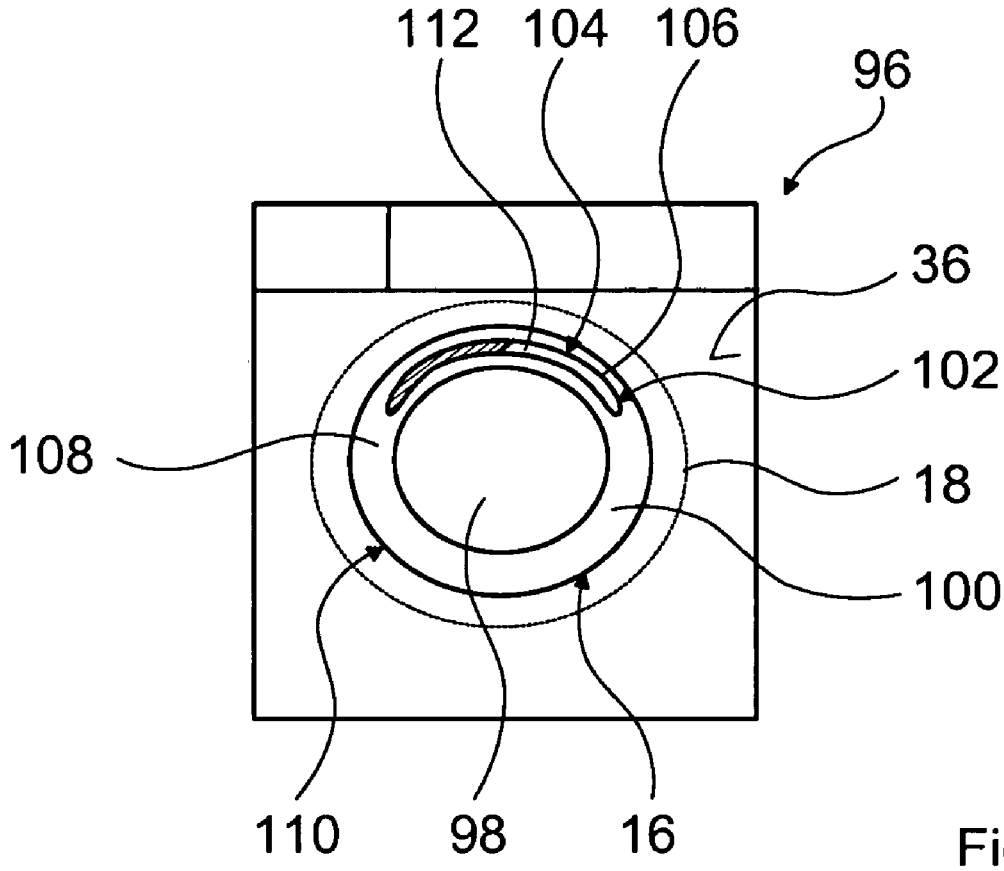
FIG. 10 is an elevation view of a washing machine with a light signal integrated into a porthole in accordance with an exemplary embodiment of the present invention.

FIGS. 8 to 10 show further embodiments of domestic appliances which are embodied as freestanding devices.

FIG. 8 shows a domestic appliance 88 embodied as a refrigerator. Components having the same function in relation to the exemplary embodiment shown in FIG. 1 are labeled with the same reference symbols. The domestic appliance 88 has a domestic appliance door unit 16 which closes off a domestic appliance functional space 18 embodied as a refrigeration chamber. Attached to the domestic appliance door unit 16, which forms a visible domestic appliance surface 36, is a grip unit 24 with a grip means 26 extending vertically. The grip unit 24 serves as a carrier unit 34 for supporting the light signal unit 32 already described above. In particular the light signal unit 32 is arranged in a subarea 38 of the carrier unit 34 which is raised above the visible domestic appliance surface 36 and serves as an actuation means 28 for actuating the domestic appliance door unit 16. By means of the light signal unit 32 for example information can be displayed about a temperature in the domestic appliance functional space 18. In this case the light signal unit 32 or the display unit 90 can be provided with linear divisions, with the reading-off of a temperature being able to be undertaken in the same way as the reading-off of a temperature from a thermometer.

FIG. 9 shows a domestic appliance 94 embodied as a dishwasher which features a domestic appliance functional space 18 embodied as a dishwasher chamber. A grip unit 24, with grip means 26 extending horizontally, is attached to a domestic appliance door unit 16 closing off the domestic appliance functional space 18, with said grip unit serving as a carrier unit 34 for supporting the light signal unit 32. For a further description, to avoid repetition, the reader is referred to the description of the domestic appliances 74 and 88. A dishwashing operation time, a remaining amount of detergent, a remaining amount of salt etc. can be displayed for example by means of the light signal unit 32 as a domestic appliance variable.

FIG. 10 shows a domestic appliance 96 embodied as a machine for handling washing, such as especially a washing machine. This features a domestic appliance functional space 18 embodied as a dishwashing chamber, which can be closed off by means of a domestic appliance door unit 16. This door unit, which is embodied in a known way as a porthole, is integrated into a visible domestic appliance surface 36 embodied as a front surface and features a first subarea 98 made of glass on which a further subarea 100 is enclosed in the form of a ring, which in the closed state of the domestic appliance door unit 16 is raised up from the visible domestic appliance surface 36. Furthermore the subarea 100 in this closed state is arranged in front of the domestic appliance functional space 18. The domestic appliance 96 is further provided with a light signal unit 102. This features a display unit 104 which includes a display means 106 embodied as an infoline. The subarea 100, which serves as an actuation means 108, especially for closing the domestic appliance door unit 16, is embodied as a carrier unit 110 for supporting the light signal unit 102. The display means 106 features a display area 112 which is embodied in a curve and extends in a circumferential direction of the annular subarea 100. This display means 106, like the embodiment of the display means 52*a*, 52*b*, 52*c*, is embodied as an infoline with the display area 112 for display of a signal section of variable length. To explain the display means 106 the reader is therefore referred to the explanation given above. To supply the light signal unit 102 with electrical energy and for control of the display unit 104, the domestic appliance 96 is provided with a transmission unit or control unit which is not shown in any greater detail, and is embodied like the transmission unit 43 or control unit 48. Information about a time of a washing process, especially a remaining time, a spin intensity etc. can be output by means of the light signal unit 102.

The invention claimed is:

1. A domestic appliance comprising:

a light signal that is raised up from a visible surface of the domestic appliance and that outputs information using light;

a controller that controls the light signal;

a carrier that is raised up from the visible surface of the domestic appliance and supports the light signal; and an operator interface supported by the carrier, the operator interface including a touch-sensitive input area, wherein the light signal includes a display that is a plurality of lights, each of the plurality of lights alternates between an off position and an on position such that the information outputted by the display indicates the progression of a variable of the domestic appliance, the touch-sensitive input area is a touch slider, and the plurality of lights is surrounded by the touch-sensitive input area.

2. The domestic appliance of claim 1, wherein the carrier includes an actuator.

3. The domestic appliance of claim 2, wherein the actuator actuates a door of the domestic appliance.

4. The domestic appliance of claim 1, wherein the carrier comprises a grip.

5. The domestic appliance of claim 4, wherein the grip comprises an elongated base element.

6. The domestic appliance of claim 1, further comprising a chassis defining a functional space and wherein the carrier includes a subarea that supports the light signal in front of the functional space.

7. The domestic appliance of claim 1, further comprising a wireless transmitter for communicating between the light signal and a chassis of the domestic appliance.

8. The domestic appliance of claim 1, wherein the controller controls a variable extent of the signal section in accordance with a characteristic value of the variable of the domestic appliance.

9. A domestic appliance of claim 1, wherein the carrier comprises a grip and the display extends in a longitudinal direction of the grip.

10. The domestic appliance of claim 1, wherein the light signal comprises a light emitting diode.

11. The domestic appliance of claim 1, wherein the light signal comprises a plurality of light emitting diodes.

12. A domestic appliance, comprising:

a front surface;

a carrier protruding from the front surface;

a light unit that is mounted on the carrier, the light unit having a plurality of individual light sections;

a controller that controls the light unit such that each of the individual light sections is controlled independently between an on position and an off position, and such that the light unit indicates the progression of a variable of the domestic appliances and an operator interface that is mounted on the carrier, the operator interface including a touch-sensitive input area, wherein the touch sensitive input area is a touch slider, and the plurality of individual light sections is surrounded by the touch-sensitive input area.

13. The domestic appliance of claim 12, further comprising a door, wherein the carrier is a handle of the door of the domestic appliance.

14. The domestic appliance of claim 13, wherein the light unit is mounted in a grip portion of the handle.

15. The domestic appliance of claim 14, wherein the light sections of the light unit are arranged in a straight line.

16. The domestic appliance of claim 14, wherein the variable of the domestic appliance is a temperature of the domestic appliance.

17. The domestic appliance of claim 14, wherein the variable of the domestic appliance is a time parameter of the domestic appliance.

18. The domestic appliance of claim 14, wherein the variable of the domestic appliance is a quantity of a substance of the domestic appliance.

19. The domestic appliance of claim 12, wherein the variable of the domestic appliance is a temperature of the domestic appliance.

20. The domestic appliance of claim 12, wherein the variable of the domestic appliance is a time parameter of the domestic appliance.

21. The domestic appliance of claim 12, wherein the variable of the domestic appliance is a quantity of a substance of the domestic appliance.

* * * * *